US005979322A

United States Patent [19]

DeMoore et al.

[11] Patent Number: 5,979,322

[45] Date of Patent: Nov. 9, 1999

[54] ENVIRONMENTALLY SAFE, INK REPELLENT, ANTI-MARKING FLEXIBLE JACKET COVERING HAVING ALIGNMENT STRIPES, CENTERING MARKS AND PRE-FABRICATED REINFORCEMENT STRIPS FOR ATTACHMENT ONTO TRANSFER CYLINDERS IN A PRINTING PRESS

[76] Inventors: Howard Warren DeMoore, 10954 Shady Trail, Dallas, Tex. 75220; John Andrew Branson, 607 Duncan Dr., Coppell, Tex. 75019

[21] Appl. No.: 08/646,443

[22] Filed: May 7, 1996

[51] Int. Cl.[6] ..... B41F 21/00; B41F 27/06; B41F 30/40

[52] U.S. Cl. ..... 101/401.1; 101/415.1; 101/493

[58] Field of Search ..... 101/415.1, 378, 101/493, 420, 417, 418, 419, 492, 483, 485, 407.1, 408, 409, 475, 401.1, 401.3

[56] References Cited

U.S. PATENT DOCUMENTS

| | | | |
|---|---|---|---|
| 4,330,798 | 5/1982 | Heyer et al. | 101/415.1 |
| 4,402,267 | 9/1983 | DeMoore | 101/419 |
| 4,691,632 | 9/1987 | DeMoore | 101/426 |
| 4,977,828 | 12/1990 | Douglas | 101/142 |
| 5,042,384 | 8/1991 | DeMoore et al. | 101/483 |
| 5,046,421 | 9/1991 | DeMoore | 101/420 |
| 5,413,044 | 5/1995 | Wu et al. | 101/420 |
| 5,415,098 | 5/1995 | Ward | 101/493 |

*Primary Examiner*—J. Reed Fisher
*Attorney, Agent, or Firm*—Locke Liddell & Sapp LLP

[57] ABSTRACT

A flexible jacket covering is pre-stretched, pre-flattened and pre-cut to predetermined length and width dimensions for attachment onto a transfer cylinder. The flexible jacket covering is marked with alignment stripes and centering marks for faster, simpler and precise attachment of the flexible jacket covering onto the transfer cylinder in an operative position. A predetermined precise amount of movement or looseness of the pre-fabricated flexible jacket covering relative to the transfer cylinder support surface is established in the operative position. Reinforcement strips are stitched onto the gripper, the tail and the operator/gear side edges of the flexible jacket covering for stabilizing the flexible jacket covering and preventing detachment from the transfer cylinder during high speed press operation. At least one side of each reinforcement strip has pressure sensitive adhesive for securing the flexible jacket covering onto the transfer cylinder.

43 Claims, 7 Drawing Sheets

ENVIRONMENTALLY SAFE, INK REPELLENT, ANTI-MARKING FLEXIBLE JACKET COVERING HAVING ALIGNMENT STRIPES, CENTERING MARKS AND PRE-FABRICATED REINFORCEMENT STRIPS FOR ATTACHMENT ONTO TRANSFER CYLINDERS IN A PRINTING PRESS

FIELD OF THE INVENTION

This invention is related generally to method and apparatus for reducing marking and smearing of freshly printed sheets, and in particular to an improved flexible jacket covering and method for accurately and securely attaching it onto transfer cylinders in a printing press.

BACKGROUND OF THE INVENTION

In the operation of a rotary offset printing press, freshly printed substrates such as sheets or web material are guided by transfer cylinders from one printing unit to another, and then they are delivered to a sheet stacker or to a sheet folder/cutter unit. Marking and smearing of the freshly printed sheets sometimes occur as follows. As each sheet is transferred from the impression cylinder, and after having received an inked image, the freshly printed sheet is immediately pulled along a reverse curvilinear path with its freshly printed side in contact with the sheet support surface of the transfer cylinder. Movement of the freshly printed sheet is so rapid that the ink on the sheet does not have time to set before it contacts the surface of the transfer cylinder; consequently, a portion of the wet ink accumulates on the transfer cylinder surface. As the next sheet and all subsequent sheets are transferred, they will be pulled into contact with the accumulated ink and thus will be marked or smeared.

DESCRIPTION OF THE PRIOR ART

The wet ink marking and smearing problems inherent in transferring freshly printed substrates have been longstanding. Various improvements have been made to the transfer cylinder surface for reducing the problems caused by ink accumulation. One of the more successful improvements is disclosed and claimed in my U.S. Pat. No. 3,791,644 wherein the sheet support surface of a transfer cylinder is in the form of a wide wheel or cylinder that is coated with polytetrafluoroethylene (PTFE) to provide a low friction, ink repellent surface.

During operation of the PTFE coated transfer cylinder in a high speed commercial printing press, the surface of the coated cylinder must be washed frequently with a solvent to remove ink accumulation. Moreover, it has also been determined that the PTFE coated cylinders do not provide the critical cushioning effect and relative movement that was needed for preventing marking and smearing.

The limitations on the use of the PTFE coated transfer cylinder have been overcome by an improved transfer cylinder having an ink repellent, stretchable and movable fabric covering for cushioning the freshly printed sheet as it is transferred. It is now well recognized and accepted in the printing industry world-wide that marking and smearing of freshly printed sheets caused by engagement of the freshly printed surface against the transfer surface of a conventional transfer cylinder is substantially eliminated by using the anti-marking, stretchable fabric covering system as disclosed and claimed in my U.S. Pat. No. 4,402,267 entitled "Method and Apparatus for Handling Printed Substrate Material", the disclosure of which is incorporated herein by reference.

The invention, which is marketed under license by Printing Research, Inc. of Dallas, Tex., U.S.A. under the registered trademark SUPER BLUE®, has a low friction fluoropolymer coating on the sheet support surface of the transfer cylinder and a movable fabric covering. The original SUPER BLUE® fabric covering is constructed of a stretchable, flexible cotton cheesecloth material that has ridges, furrows, rows and wrinkles. The SUPER BLUE® fabric covering provides stretchable, cushioning support for the freshly printed side of the substrate such that relative movement between the freshly printed substrate and the transfer cylinder surface takes place between the stretchable fabric covering and the cylinder surface so that marking and smearing of the freshly printed side is substantially reduced.

The original SUPER BLUE® transfer cylinder and stretchable fabric covering system has achieved world-wide commercial success. However, with continuous use such as is common on printing presses, the original stretchable fabric covering requires re-adjustment and tightening to provide the proper amount of looseness or relative movement of the stretchable covering relative to the transfer cylinder surface. After extended use without such re-adjustment or tightening, the stretchable fabric covering will become so loose that it can be caught on press parts and torn from the transfer cylinder, almost always smashing the blankets.

Some printing presses have been constructed with closer clearance between the impression cylinder and the transfer cylinder with the expectation that sheet registration will improve. However, the close cylinder clearance has not improved registration and has actually made the marking problem worse. Moreover, the close cylinder clearance has restricted the use of conventional mechanical fasteners for attaching the stretchable jacket covering onto the transfer cylinder. The reason for that limitation is that the combined thickness of the stretchable fabric covering and the mechanical fastener that attaches it onto the transfer cylinder should not exceed the radial projection of the gripper pads that are located adjacent to the gripper edge of the transfer cylinder. Any portion of the fastener or the stretchable fabric covering that projects beyond the allowable clearance will accumulate ink that will subsequently mark the freshly printed sheets as they are transferred from the impression cylinder.

For some presses, the radial projection of the gripper pads relative to the transfer cylinder sheet support surface is only about 3/32" (about 2.4 mm). This limitation rules out the use of conventional hook-and-loop pile fasteners (e.g. VELCRO® fasteners) for attaching the stretchable fabric covering onto the transfer cylinder.

A double-sided adhesive tape is sometimes used for attaching the stretchable fabric covering onto the transfer cylinder. When it is necessary to replace the stretchable fabric covering, the press operator will sometimes pull the stretchable fabric covering away from the adhesive tape without removing or replacing the used adhesive tape from the transfer cylinder. After the worn fabric covering is removed, the press operator will often attempt to re-establish the adhesive properties and restore the holding power of the used adhesive tape by applying a solvent such as alcohol to the adhesive surface of the used tape. This has been found to temporarily restore the adhesion of the used tape. However, frequent failures of the re-used, rejuvenated adhesive tape strip have caused the replacement stretchable fabric covering to detach from the transfer cylinder and damage the printing blankets or other press parts.

According to the original installation method, the stretchable fabric covering is attached onto the transfer cylinder in two steps. First, one adhesive side of a double-sided adhesive tape is attached onto the gripper edge of the transfer cylinder, and then the gripper edge of the stretchable fabric covering is pressed onto the exposed adhesive side of the tape. It is difficult to align and fasten the stretchable fabric covering to the tape because of the stretchability of the original fabric material. Moreover, the original stretchable fabric covering tends to bunch-up as it is being attached, thus creating wrinkles or high spots that will accumulate ink and cause marking.

Another result of re-using the original adhesive tape is that even if a replacement fabric covering is attached in good alignment and with the appropriate looseness, the re-used adhesive tape will lose its adhesive properties. Consequently, the replacement stretchable fabric covering is more likely to separate as a result of normal wear-and-tear and because of centrifugal forces exerted by high speed press operation.

For these reasons, there has been continuing development and improvement in the design of anti-marking fabric coverings and attachment methods to overcome the limitations imposed by the stretchability of the original fabric covering material and the close cylinder clearances.

SUMMARY OF THE INVENTION

In accordance with one aspect of the present invention, a flexible, substantially non-stretchable jacket covering is constructed of a dimensionally stable, flexible fabric material, preferably cotton cheesecloth, that is pre-stretched and pre-flattened to remove all wrinkles, ridges, rows, furrows and the like. Moreover, the flexible jacket covering is pre-cut to predetermined length and width dimensions for attachment onto a particular size transfer cylinder. Preferably, the flexible jacket covering is marked with one or more horizontal and/or vertical alignment stripes and one or more centering marks for faster, simpler alignment and precise attachment that provide a predetermined amount of looseness or movement of the flexible jacket covering relative to the transfer cylinder surface when the flexible jacket covering is attached onto the transfer cylinder in the operative position. According to this arrangement, the prefabricated flexible jacket covering is readily attached onto a transfer cylinder without requiring on-press measuring or trimming of the flexible jacket covering.

In this precision, pre-cut, pre-stretched, pre-flattened and pre-fabricated embodiment, the transfer cylinder support surface or the cylinder base covering is also marked with one or more centering marks for facilitating quick and precise attachment of the flexible jacket covering onto the transfer cylinder. When the prefabricated flexible jacket covering is secured onto the transfer cylinder in the operative position, the gripper edge and tail edge of the flexible jacket covering are precisely aligned with the gripper edge portion and tail edge portion of the transfer cylinder, and a predetermined amount of moveability or looseness of the flexible jacket covering relative to the transfer cylinder support surface is established.

According to another aspect of the present invention, one or more reinforcement strips are permanently attached to one or more edges of the flexible jacket covering for mechanically stabilizing the flexible jacket covering material and preventing separation of the flexible jacket covering material from the reinforcement strip and/or from the transfer cylinder during press operation. Preferably, a reinforcement strip is attached onto at least the gripper edge of the flexible jacket covering. Optionally, additional reinforcement strips are attached onto the tail edge and operator/gear side edges of the flexible jacket covering, respectively.

The reinforcement strips are permanently attached to the flexible jacket covering by various means such as threaded or stranded stitching, adhesive deposits, thermoplastic welded unions, and mechanical fasteners including staples and clamps. Each reinforcement strip is provided with pressure-sensitive adhesive for securing the flexible jacket covering onto the transfer cylinder. For those flexible jacket coverings that are intended for use in printing presses having close cylinder clearances, the reinforcement strip, the flexible jacket covering material and the fasteners are carefully selected to provide a total thickness that does not exceed the radial projection of the gripper pads.

BRIEF DESCRIPTION OF THE DRAWINGS

Multiple embodiments of the present invention will now be described with reference to the accompanying drawings in which.

DETAILED DESCRIPTION OF THE PREFERRED EMBODIMENTS

The terminology "transfer cylinder" and "transfer means" as used herein means and refers to transfer cylinders, delivery cylinders, transfer rollers, support rollers, delivery wheels, skeleton wheels, segmented wheels, transfer drums, support drums, spider wheels, support wheels, guide wheels and any other rotatable member that is capable of transferring a freshly printed substrate in a printing press.

In the exemplary embodiments discussed below, the substrate S is described as being in sheet form. It will be understood, however, that the principles of the present invention are equally applicable to a printed substrate in web form.

The improved method and apparatus for handling freshly printed substrate material in accordance with the present invention is used in combination with printing presses of the type used, for example, in rotary offset printing. Such equipment typically includes one or more transfer cylinders 10 for transferring the freshly printed substrate material, either in sheet form or in web form, between printing units and from the last printing unit to a delivery sheet stacker or a sheet folder/cutter unit. The particular location of each transfer cylinder 10 at an interunit transfer position (T1, T3) or the delivery cylinder 10D at a delivery position (T4) in a typical four unit rotary offset printing press 12 as shown in FIG. 1 is believed to be understood by those skilled in the art.

Figure 6:
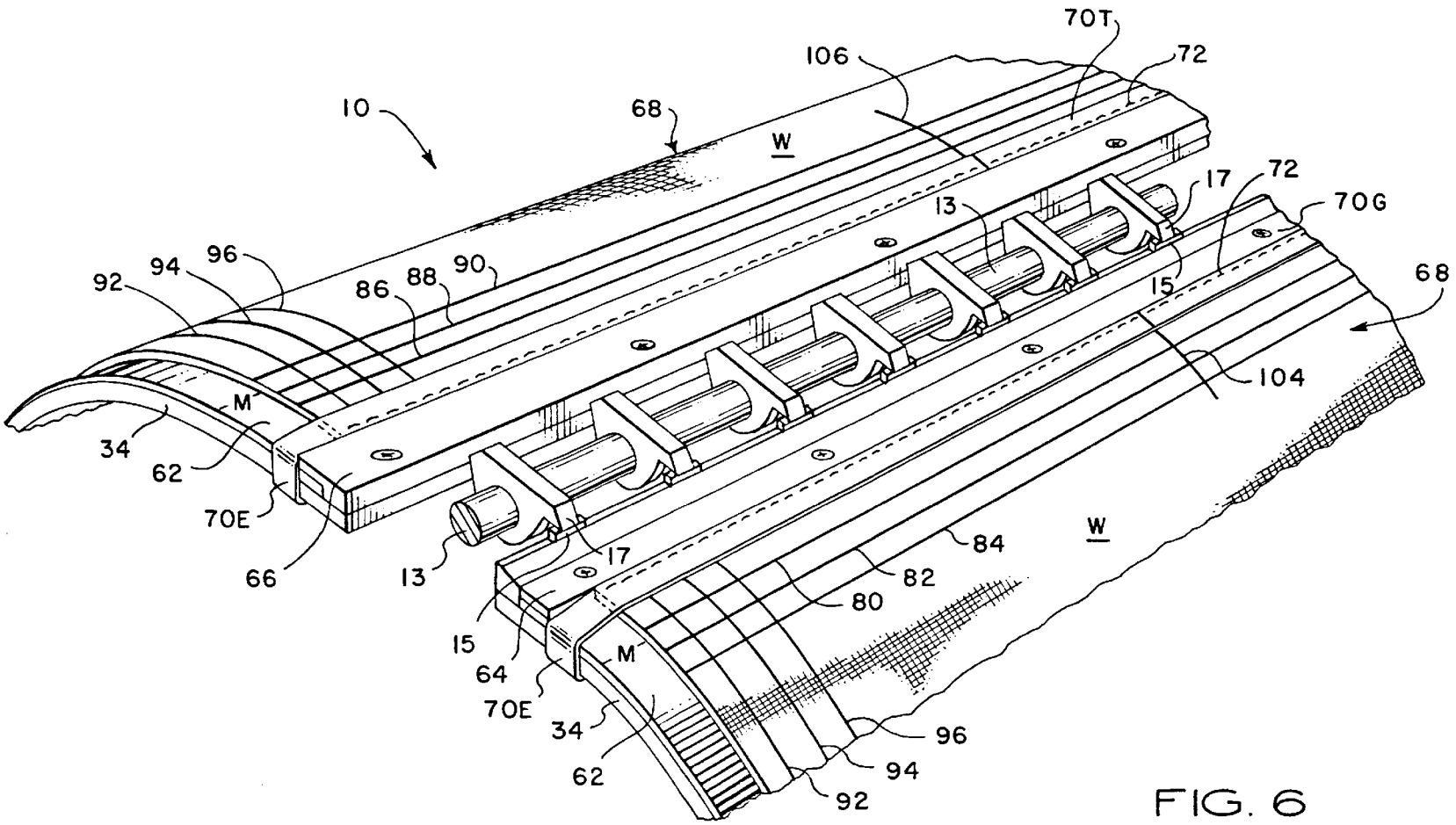
FIG. 6 is a partial perspective view comparable to FIG. 2 showing attachment of the compact, prefabricated flexible jacket covering of FIG. 7 attached onto a transfer cylinder.
Figure 8:
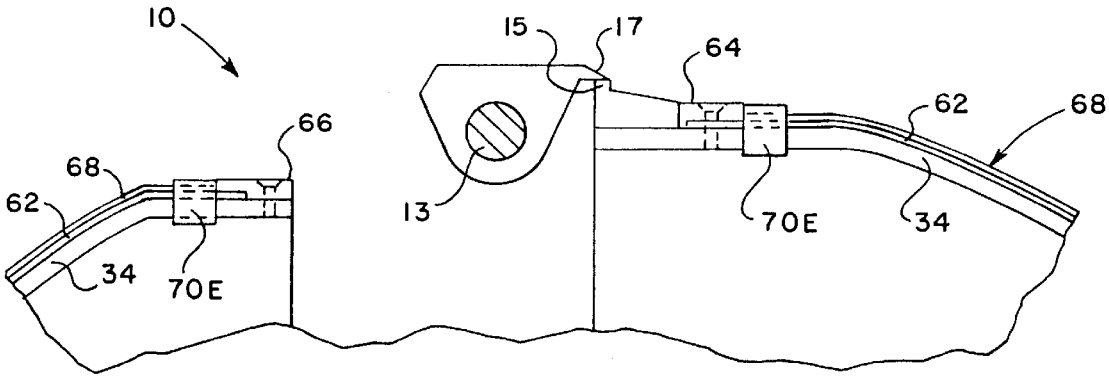
FIG. 8 is a simplified side elevational view, partially broken away, showing the attachment of the compact, prefabricated flexible jacket covering of FIG. 7 onto the transfer cylinder of FIG. 6.
Figure 9:
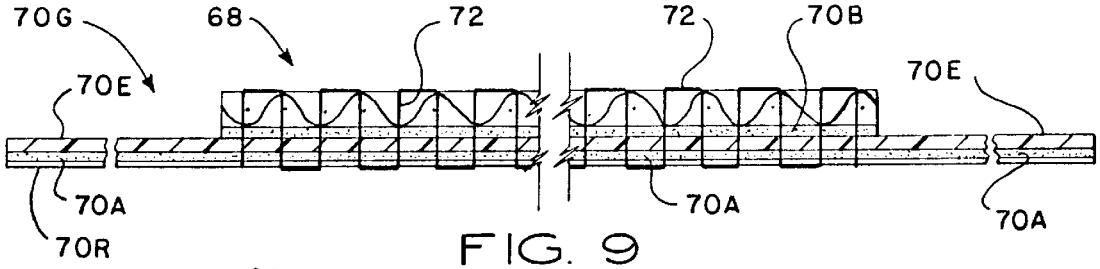
FIG. 9 is a simplified sectional view showing stitched attachment of a reinforcement strip onto the flexible jacket covering of FIG. 5.

Whether a particular cylinder is designated as being a transfer cylinder 10 or a delivery cylinder 10D depends upon its construction and location within the press. Those transfer cylinders 10 that are located at interunit transfer positions (T1, T3) are equipped with gripper bars 13 having gripper pads 15 and fingers 17 (as shown in FIG. 6 and FIG. 8) for gripping a freshly printed sheet. In the delivery position (T4), the delivery cylinder 10D does not have grippers, but instead has a longitudinal pocket A to permit the passage of gripper bars carried by sprocket driven delivery chains. Reference should be made to my earlier U.S. Pat. Nos. 3,791,644 and 4,402,267 for details regarding the location and function of transfer and delivery cylinders in a typical multi-unit rotary offset printing press. The method and apparatus of the present invention can, of course, be utilized with printing presses having any number of printing units.

Figure 1:
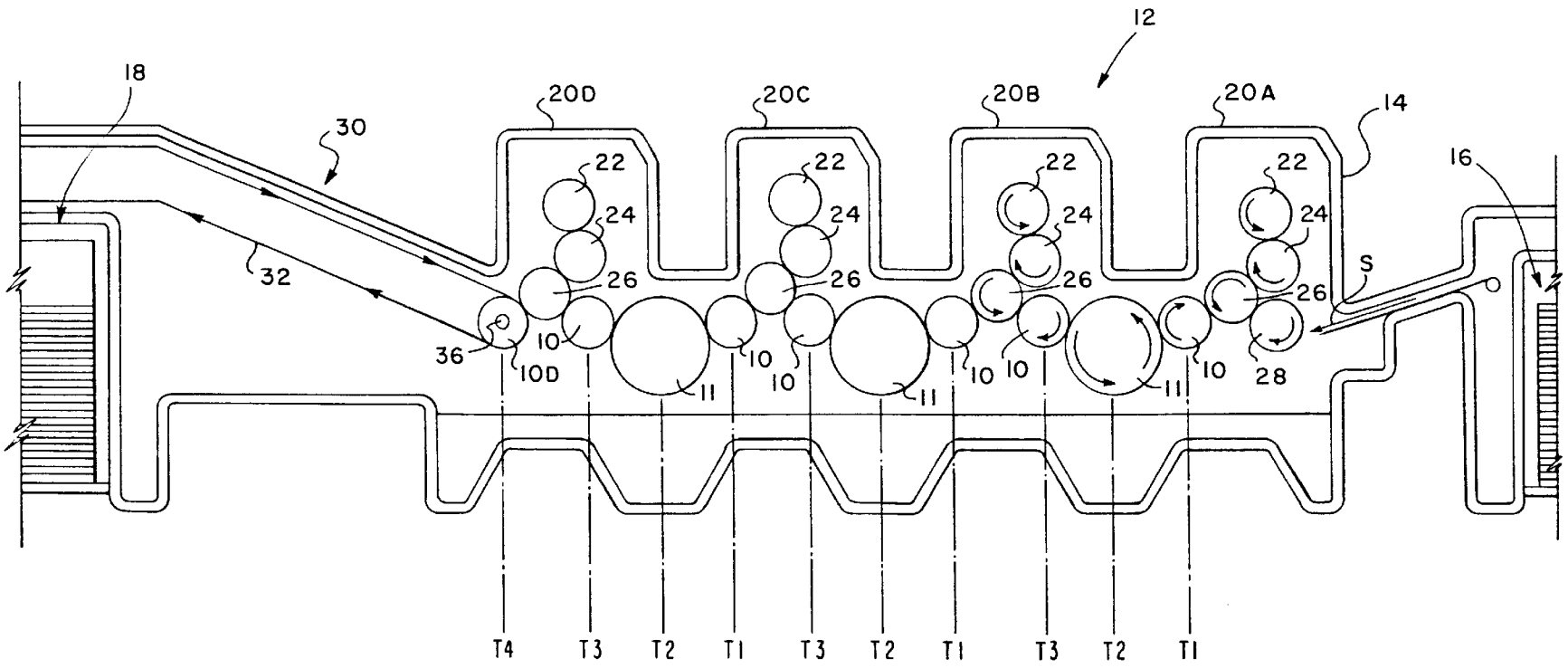
FIG. 1 is a schematic side elevational view showing multiple transfer cylinders installed at interunit transfer positions in a four color rotary offset printing press.

Referring to FIG. 1, the rotary offset press 12 includes a press frame 14 coupled on its right end to a sheet feeder 16 from which sheets, herein designated S, are individually and sequentially fed into the press. At its delivery end, the press 12 is coupled to a delivery sheet stacker 18 in which the freshly printed sheets are collected and stacked. Interposed between the sheet feeder 16 and the delivery sheet stacker 18 are four substantially identical rotary offset printing units 20A, 20B, 20C, and 20D that are capable of printing different color inks onto the sheets S as they are transferred through the press.

As illustrated in FIG. 1, each printing unit is of conventional design, and includes a plate cylinder 22, a blanket cylinder 24 and an impression cylinder 26. The first printing unit 20A is equipped with an in-feed roller 28 that feeds individual sheets S one at a time from the sheet feeder 16 to the impression cylinder 26 of the first printing unit 20A. Freshly printed sheets S are transferred from the impression cylinder 26 to the second printing unit by the transfer cylinder 10.

The freshly printed sheets S are transferred from the last printing unit 20D to the delivery sheet stacker 18 by a delivery conveyor system, generally designated 30. The delivery conveyor system 30 is of conventional design and includes sprocket driven delivery chains 32 carrying gripper bars, each gripper bar having gripper pads and fingers for gripping the leading (gripper) edge of a freshly printed sheet S as it leaves the last impression cylinder 26 at the delivery position T4. As the gripper edge of the freshly printed sheet S is gripped by the gripper fingers, the delivery chains 32 pull the gripper bar and sheet S away from the impression cylinder 26 of the last printing unit 20D and deliver the freshly printed sheet S to the delivery sheet stacker 18.

An intermediate transfer cylinder 11 receives freshly printed sheets from the transfer cylinder 10 of the preceding printing unit. Each intermediate transfer cylinder 11, which is of conventional design, typically has a diameter twice that of the transfer cylinder 10, and is located at an intermediate position T2 between the interunit transfer positions T1, T3 of each printing unit as shown in FIG. 1. The impression cylinders 26, the intermediate transfer cylinders 11, the transfer cylinders 10, as well as the sheet in-feed roller 28, are each provided with a gripper bar 13, gripper pad 15 and gripper fingers 17 which grip the leading (gripper) edge of the sheet S to pull the freshly printed sheets around the transfer cylinders 10 in the direction indicated by the associated arrows. The delivery cylinder 10D in the delivery position T4 is not equipped with grippers, and includes instead a longitudinal pocket A that provides passage clearance for the chain driven delivery gripper bars.

The function and operation of the transfer and delivery cylinders and associated grippers of the printing units are believed to be well known to those familiar with multi-unit or multi-color presses, and need not be described further except to note that in each printing unit, the impression cylinder 26 functions to press the sheets against the blanket cylinder 24 which applies an inked image onto the sheets S. Each transfer cylinder 10 transfers the freshly printed sheets away from the impression cylinder 26 with the freshly printed side of each sheet facing the support surface of each transfer cylinder 10 and delivery cylinder 10D. Further, each transfer cylinder 10 and transfer cylinder 10D are provided with a low friction, electrically conductive cylinder base covering 62 and a cushioning, ink repellent, anti-static or conductive flexible jacket covering 68 as described below.

Figure 2:
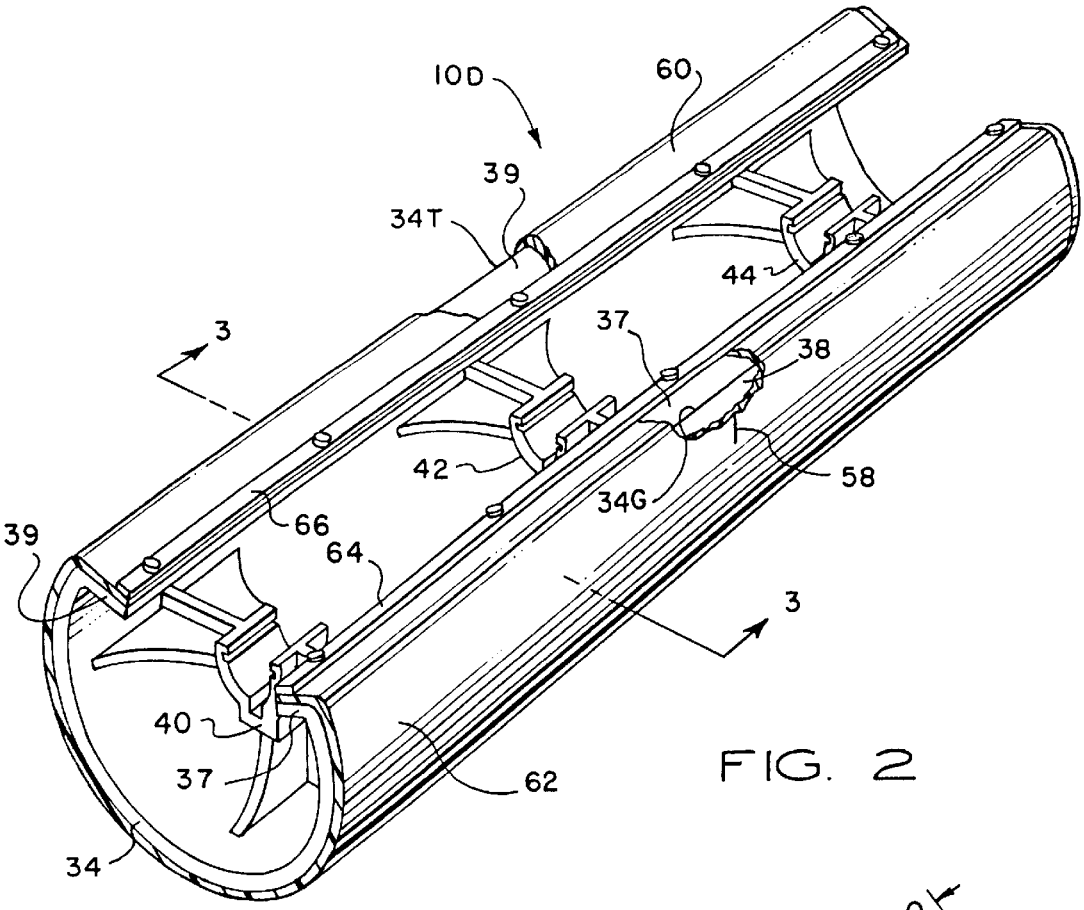
FIG. 2 is a perspective view of a delivery cylinder having a low friction, conductive, cylinder base covering with centering marks for precision attachment of a pre-cut, pre-stretched, pre-flattened, ink repellent and conductive flexible jacket covering onto the delivery cylinder.
Figure 3:
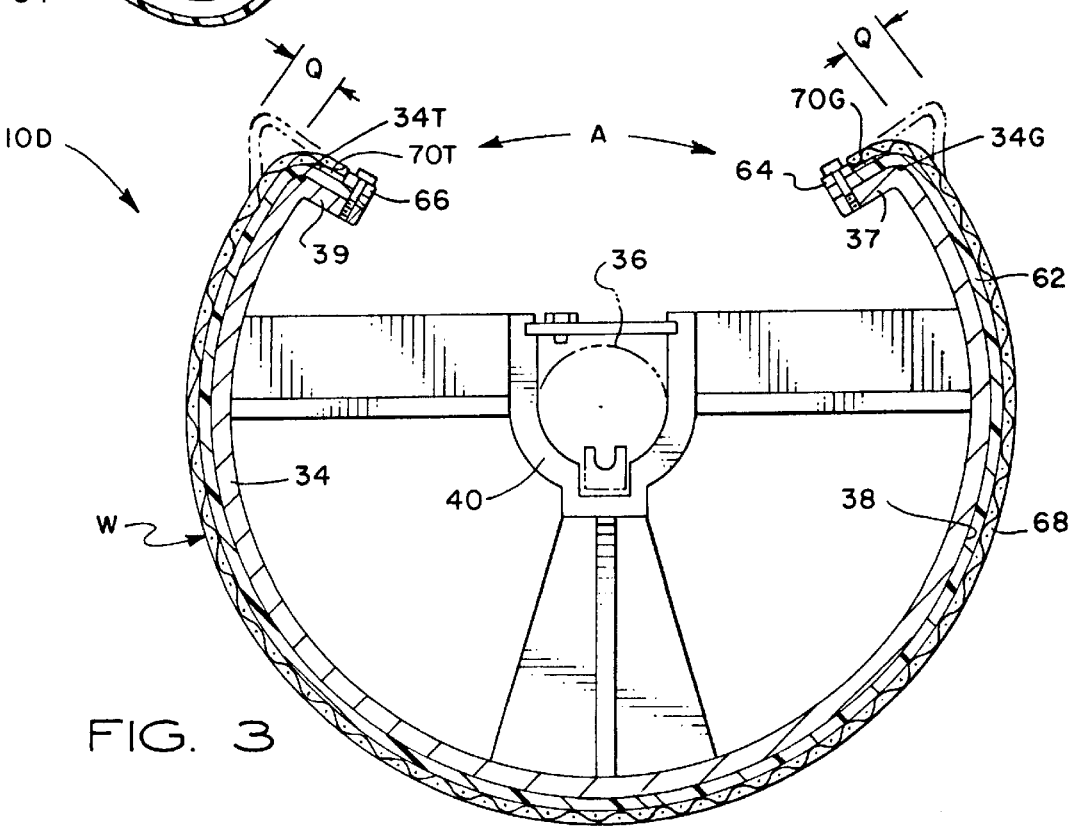
FIG. 3 is a sectional view thereof, taken along the line 3—3 of FIG. 2, showing the prefabricated flexible jacket covering movably attached onto the delivery cylinder in an operative position.

Referring now to FIG. 1, FIG. 2 and FIG. 3, the delivery cylinder 10D is installed adjacent the last printing unit 20D of the press 12 in the delivery position (T4) and has a rim 34 that is supported for rotation on the press frame 14 by a rotatable delivery shaft 36. The rim 34 has a curved, semi-cylindrical support surface 38 that is intersected by a pocket A extending longitudinally along the axial length of the delivery cylinder and circumferentially between a gripper edge portion and a tail edge portion, respectively. The gripper edge portion and the tail edge portion are formed by inwardly projecting flanges 37, 39 which are integrally joined with the curved rim 34 along a gripper edge 34G and a tail edge 34T, respectively. The delivery cylinder 10D is attached to the delivery shaft 36 by longitudinally spaced hubs 40, 42 and 44.

Figure 4:
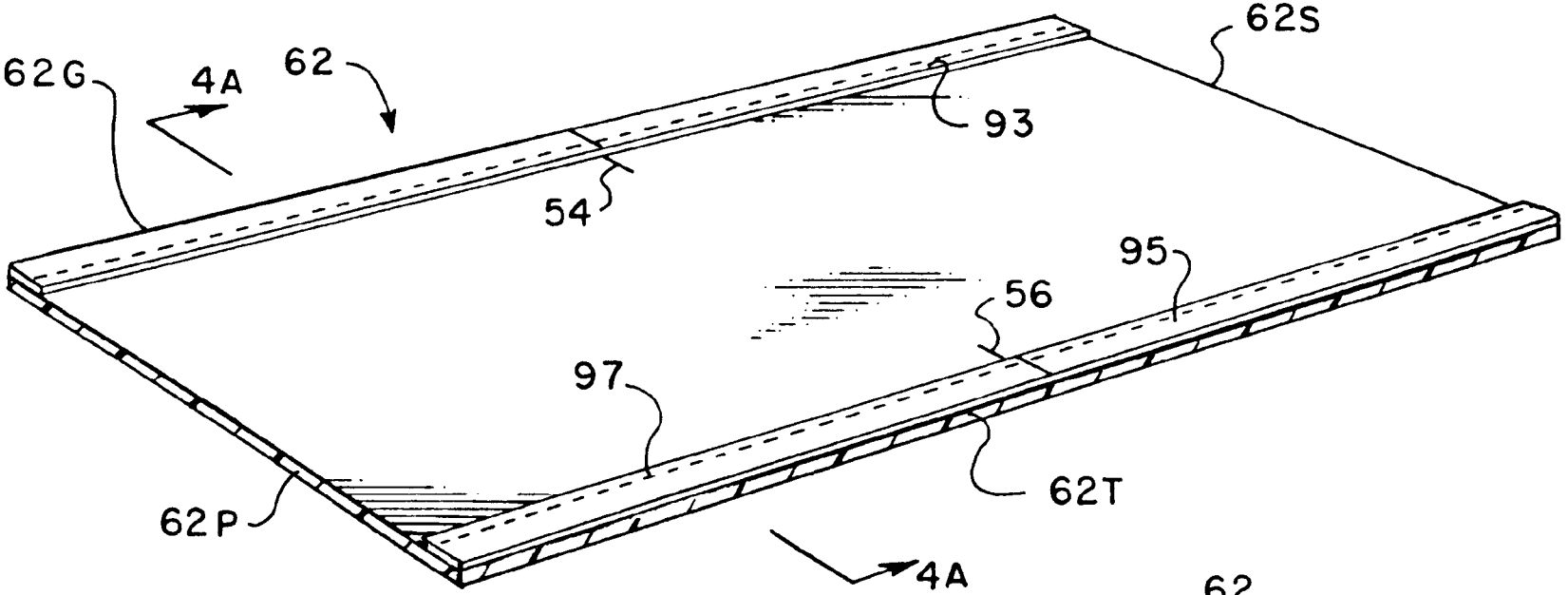
FIG. 4 is a partial perspective view of a low friction, conductive cylinder base covering having centering marks and bonding strips.

The delivery cylinder surface 38 shown in FIG. 1 and FIG. 2 is covered by a low friction, conductive or semi-conductive, anti-static cylinder base covering 62 (FIG. 4). As used herein, "conductive", "semi-conductive" and "anti-static" mean and refer to the ability of a material to conduct or transfer an electrical charge by the passage of electrons or ionized atoms. The term "semi-conductive" specifically refers to a conductive material whose surface resistivity at room temperature (70° F., 21° C.) is in the range of about $10^{-2}$ ohm-centimeter to about $10^{9}$ ohms-centimeter, which is between the resistivity of metals and insulators.

Preferably, the surface resistivity of the conductive cylinder base covering 62 does not exceed approximately 75,000 ohms per square. Other surface resistivity values may be used to good advantage, for example in the surface resistivity range of 50,000 ohms per square to 100,000 ohms per square. The coefficient of friction of the cylinder base covering preferably does not exceed surface approximately 0.110.

The low friction, conductive cylinder base covering 62 is attached onto the transfer cylinder 10D by clamp bars 64, 66. Preferably, centering marks 54 and 56 are formed on the transfer surface of the low friction, conductive cylinder base covering. The purpose of the centering marks is to facilitate the accurate placement, precise alignment and secure attachment of the flexible jacket covering 68 (FIG. 5) onto the delivery cylinder 10D (FIG. 2).

Figure 5:
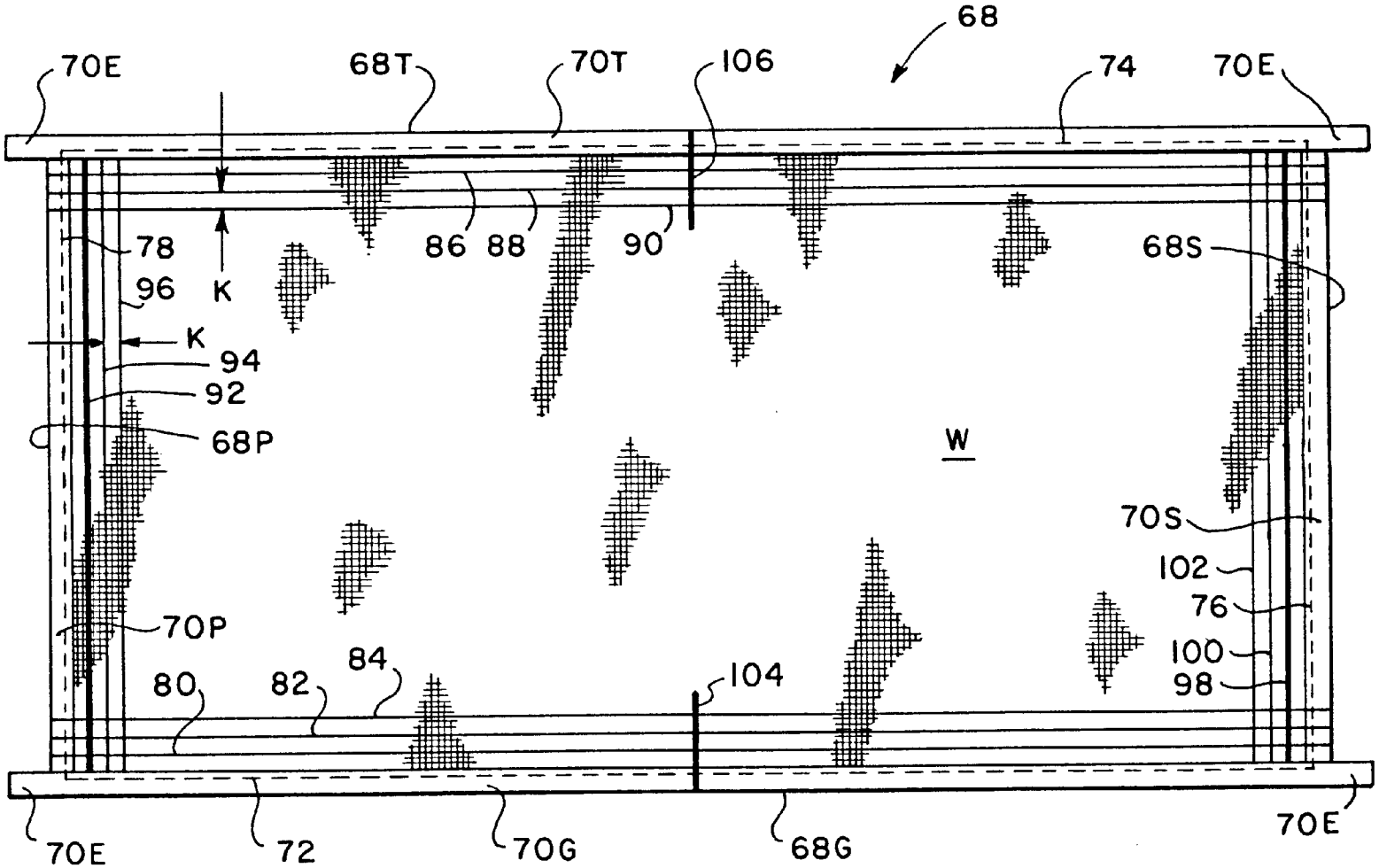
FIG. 5 is a top plan view of a pre-fabricated flexible jacket covering having edge reinforcement strips, centering marks and multiple alignment stripes.

Referring now to FIG. 3, FIG. 4 and FIG. 5, the low friction, semi-conductive cylinder base covering 62 and the flexible, ink repellent and anti-static or conductive jacket covering 68 are attached onto the delivery cylinder 10D for cushioning the printed side of a freshly printed sheet S while transferring the freshly printed sheet to the next printing unit or to the press delivery sheet stacker 18. Although the fluoropolymer covered delivery cylinder disclosed in my U.S. Pat. No. 3,791,644 and the ink repellent, stretchable fabric covering disclosed in my U.S. Pat. No. 4,402,267 provided improvements in transferring freshly printed sheet material, we have discovered that the pre-stretched, pre-flattened and edge-reinforced flexible jacket covering 68 further improves the ability of each transfer cylinder 10 and delivery cylinder 10D to support and transfer successive sheets S of freshly printed material without transferring the wet ink from a previous sheet to successive sheets and without marking, smearing or indenting the surface of the freshly printed sheets.

Attachment of the flexible jacket covering 68 onto the transfer delivery cylinder 10D and/or the cylinder base covering 62 is substantially simplified and improved by stabilizing at least the gripper edge 68G of the flexible jacket covering 68, and preferably the tail edge 68T and operator/gear side edges 68P, 68S of the flexible jacket covering 68 with reinforcement strips 70G, 70T, 70P and 70S, respectively. Preferably, the ink repellent, anti-static flexible jacket covering 68 and the low friction, conductive cylinder base covering 62 each have a flat, rectangular shape. In this delivery cylinder embodiment, the low friction, conductive cylinder base covering 62 is dimensioned to cover substantially all of the sheet support surface 38 of the delivery transfer cylinder 10D, and the full-size prefabricated, ink repellent, conductive flexible jacket covering 68 of FIG. 5 is wider than the delivery transfer cylinder, whereby projecting side portions of the flexible jacket covering can be folded around and attached to the underside of the transfer cylinder rim 34.

It has been observed that the marking problem is most acute near the gripper edge of the transfer cylinder, and that marking and smearing diminish toward the tail edge of the transfer cylinder. Moreover, during high speed operation, the flexible jacket covering tends to draw up or bunch up toward the middle of the flexible jacket covering in response to centrifugal forces. Ink will accumulate on the bunched-up surfaces, thus causing marking and smearing. This problem is prevented, according to one aspect of the present invention, by tacking or attaching marginal side edge portions of the flexible jacket covering onto the operator side edge and onto the gear side edge of the transfer cylinder. Preferably, the side edge portions of the flexible jacket covering are spot-tacked onto the operator side edge and the gear side edge of the transfer cylinder, for example by VELCRO® fasteners or adhesive tab portions 70E. Moreover, the attachment points of the adhesive tab portions are preferably located circumferentially intermediate the longitudinal center line and the tail edge of the flexible jacket covering.

In the preferred embodiment, the prefabricated flexible jacket covering 68 is made of a natural material, for example cotton, hemp, wool, silk, linen and the like. Best results have been obtained by using 40 mesh woven fabric, for example cotton cheesecloth having a weave of 32 warp×28 weft (fill). Moreover, the cotton cheesecloth is treated with an ink-repellent compound such as SCOTCHGUARD® liquid conditioner and treated with an anti-static ionic polymer compound, or is otherwise rendered conductive or semi-conductive. For example, the cotton cheesecloth material can be rendered conductive by weaving one or more conductive strands in the weft (fill) position and also weaving one or more conductive strands in the warp position, preferably across the entire length and width of the flexible jacket covering. Synthetic polymer materials such as open or closed cell polyester foam in sheet form also can be used as the flexible jacket material.

According to an important aspect of the present invention, the cotton cheesecloth material is pre-stretched and pre-flattened so that it is dimensionally stable. As used herein, "dimensionally stable" as applied to the flexible jacket material means and refers to the ability of the material to substantially resist elongation in response to a tension force. Preferably, the elongation of the tensioned flexible jacket material is less than about two percent (2%) of its relaxed length in response to the tension forces induced in the flexible jacket covering during sheet transfer operation. A dimensionally stable woven material that satisfies this requirement is cotton cheesecloth that has a strength and elongation rating (for a one inch (2.54 cm) by six inch (15 cm) sample) that does not exceed about seven percent (7%) in warp elongation at breakage, and does not exceed about twelve percent (12%) in weft (fill) elongation at breakage.

According to an alternative arrangement, the woven strands or threads of flexible jacket material are composed of polymers or co-polymers selected from the group including polyesters, polyacrylates, polyolefins, polyimides and polyamides. Conductivity of the strands or threads is obtained by impregnating or otherwise treating the strands or threads with an aqueous solution of an anti-static ionic polymer compound selected from the group including ammonium salts, polyglycerol esters and sorbitan esters. The flexible jacket covering 68 can be treated either by soaking the flexible covering material in an aqueous solution of an anti-static ionic polymer compound, or by spraying the aqueous solution of anti-static ionic polymer compound onto the flexible jacket covering, or by impregnating the threads or strands of the flexible jacket covering with the aqueous anti-static ionic compound prior to weaving. Alternatively, the strands are rendered conductive by applying a conductive fluropolymer resin coating on each strand.

Preferably, at least one weft (fill) strand has a color that contrasts with the color of at least one other strand of the weave, thereby defining at least one contrasting stripe in or on the flexible jacket covering. Multiple strands having a black color are interwoven with multiple white strands, thereby defining black alignment stripes and white alignment stripes in parallel alignment with the gripper edge and the tail edge of the flexible jacket covering 68. Strands or threads having another contrasting color, such as blue, are also interwoven to define a blue background field. Alternatively, the flexible jacket material is selected to provide a contrasting background field, and the contrasting alignment stripes are painted or printed on the background field of the flexible jacket covering.

Moreover, the contrasting alignment stripes are separated with respect to each other by a spacing distance K, with the parallel alignment stripes alternating in color. The spacing distance K in this exemplary embodiment is one-half inch (1.3 cm). It will be appreciated that the contrasting stripes provide accurate initial placement, faster, easier attachment and precise alignment of the ink repellent, conductive flexible jacket covering 68 onto the delivery cylinder 10D.

The alignment stripes are formed on or in the flexible jacket material W for accurately positioning and precisely aligning the flexible jacket covering 68 onto the transfer delivery cylinder 10D. For this purpose, longitudinally extending (horizontal) alignment stripes 80, 82, 84 and 86, 88 and 90 are formed in or on the flexible jacket material W in parallel alignment with the reinforcement strips 70G and 70T. Likewise, vertical (circumferential) alignment stripes 92, 94, 96 and 98, 100 and 102 are formed in or on the flexible jacket material W in parallel alignment with the reinforcement strips 70S and 70P. Preferably, the alignment stripes 92, 98 are selected for accurately aligning the full-sized flexible jacket covering 68 with the operator and gear side edges of the transfer cylinder 34. The flexible jacket covering material W and the alignment stripes are formed of contrasting colors. In the preferred embodiment, black and white alignment stripes and black and white vertical alignment stripes alternate with each other over a blue background field.

Referring again to FIG. 5, the preferred embodiment of the ink repellent, conductive flexible jacket covering 68 has a gripper edge 68G, a tail edge 68T, a gear side edge 68S and an operator side edge 68P. According to an important feature of the present invention, the edges of the flexible jacket covering 68 are stabilized by reinforcement strips 70G, 70T, 70S and 70P, respectively. The reinforcement strips have at least one adhesive side and are permanently attached to the edge portions of the flexible jacket covering 68 for the purpose of mechanically stabilizing the edges of the flexible jacket covering material and for preventing separation of the flexible jacket covering from the reinforcement strip and/or from the delivery cylinder during high speed press operation.

Figure 10:
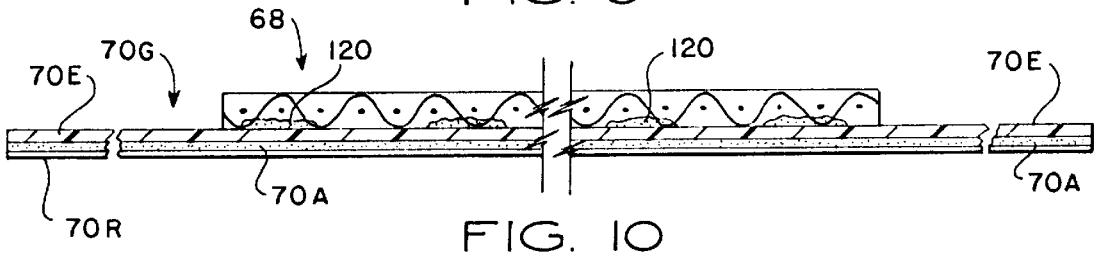
FIG. 10 is a sectional view similar to FIG. 9 in which a reinforcement strip and a flexible jacket covering are attached by deposits of contact adhesive.
Figure 11:
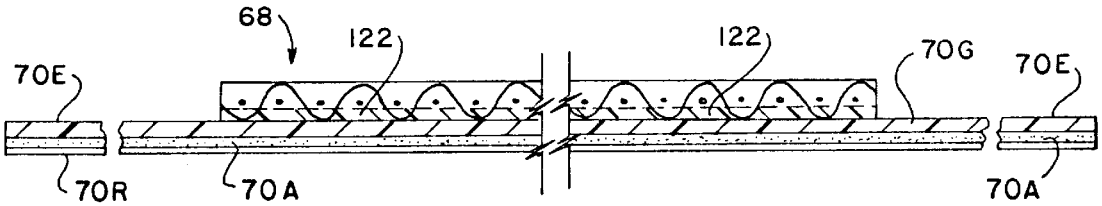
FIG. 11 is a view similar to FIG. 9 in which a reinforcement strip is attached onto a flexible jacket covering by a thermoplastic weld union.
Figure 12:
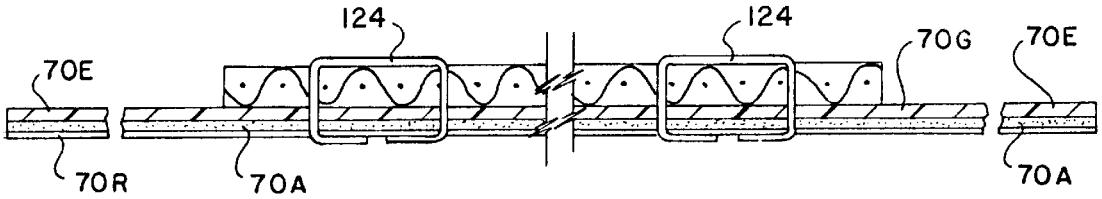
FIG. 12 is a view similar to FIG. 9, in which a reinforcement strip is attached onto a flexible jacket covering by staple fasteners; and, FIG. 13 is a top perspective view similar to FIG. 7 in which a reinforcement strip is attached onto a flexible jacket covering by clamp fasteners.
Figure 13:
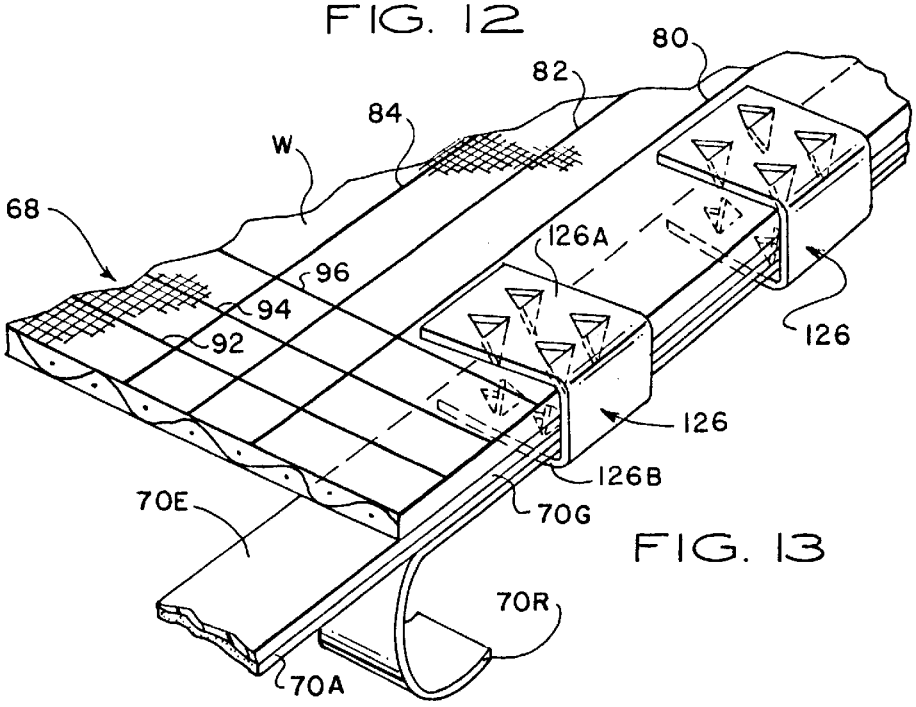

Preferably, the reinforcement strips are permanently attached to the flexible jacket covering 68 by threaded stitching, as indicated by the dashed lines 72, 74, 76 and 78 (FIG. 5). Other fastener means including adhesive deposits 120 (FIG. 10), thermoplastic welded unions 122 (FIG. 11), and penetrating mechanical fasteners including staples 124 (FIG. 12) and clamps 126 having clamping jaws 126A, 126B (FIG. 13) can also be used for permanently attaching the reinforcement strips to the flexible jacket covering material W. At least one side of each reinforcement strip is provided with pressure-sensitive adhesive 70A for securing the jacket covering onto the delivery transfer cylinder 10D. Stitching and double-sided adhesive tape are preferred, since the stitched combination of the reinforcement strip and flexible jacket covering does not exceed the radial projection of the gripper pads 15. As used herein, "double-sided" adhesive tape means and refers to adhesive tape having pressure-sensitive adhesive on both sides of the tape.

The circumferential length between the clamp bars 64,66 is known and the flexible jacket covering 68 is pre-cut according to the known size of the transfer cylinder, so that a predetermined amount of movability or looseness Q is established when the flexible jacket covering is attached onto the low friction, conductive cylinder base covering 62 in the operative position (FIG. 3). Preferably, the flexible jacket covering is movable or displaceable in all directions from any point on the cylinder base covering 62 by dimension Q of about one-sixteenth inch (about 2 mm) to about one inch (about 2.54 cm) in response to moderate, smoothing hand pressure applied to the flexible jacket covering 68. The maximum allowable displacement Q is determined by the cylinder clearances, and should not exceed the gripper pad clearance. By this pre-measured, prefabricated arrangement, a predetermined amount Q of flexible jacket covering looseness or movement relative to the transfer cylinder surface is precisely established when the flexible jacket covering is secured onto the transfer cylinder in the operative position.

To simplify the initial placement and alignment of the flexible jacket covering 68 onto the delivery transfer cylinder 10D, centering marks 104 and 106 are formed in or on the flexible jacket covering 68. Preferably, the centering marks 104, 106 bisect the flexible jacket covering and extend in parallel with the vertical alignment stripes 92, 94, 96.

Referring again to FIG. 3, the preferred method of attaching the flexible jacket covering 68 to the delivery transfer cylinder 10D is illustrated. First, the low friction, conductive cylinder base covering 62 is secured around the bare cylinder surface 38 of the transfer cylinder rim 34 by the clamp bars 64, 66 as shown in FIG. 1. Next, the prefabricated, flexible jacket covering 68 is positioned over the cylinder base covering 62 with its centering marks 104, 106 in registration with the corresponding centering marks 54, 56, on the low friction, conductive cylinder base covering 62. Also, the edge alignment stripes 92, 98 of the flexible jacket covering are positioned on the operator and gear side edges of the transfer cylinder.

After the initial placement of the flexible jacket covering 68, registration of the respective centering marks and alignment of the alignment stripes are verified. The gripper reinforcement strip 70G is positioned flush against the gripper edge clamp bar 64 which sets the horizontal alignment stripes 80, 82, 84 in parallel alignment with the gripper and tail edges 34G, 34T of the transfer cylinder rim 34. The exposed adhesive side 70A of the gripper edge reinforcement strip 70G is then pressed onto the gripper edge portion 62G of the cylinder base covering 62 that overlies the gripper flange 37. Next, the tail reinforcement strip 70T is positioned flush against the tail edge clamp bar 66 which sets the horizontal stripes 86, 88, 90 in parallel alignment with the gripper and tail edges 34G, 34T of the transfer cylinder rim 34. The exposed adhesive side 70A of the tail edge reinforcement strip 70T is then pressed onto the tail edge portion 62T of the cylinder base covering 62 that overlies the tail flange 39.

Each reinforcement strip 70G, 70T has opposite end portions 70E that are long enough to fold around the operator and gear side edges of the transfer cylinder rim 34 in the operative position as shown in FIG. 6 and FIG. 8. The adhesive sides 70A further secure the attachment of the flexible jacket covering onto the transfer cylinder rim 34.

Figure 4A:
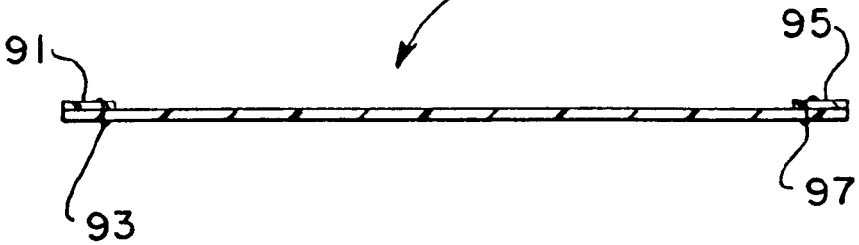
FIG. 4A is a sectional view of the low friction, conductive cylinder base covering taken along the lines 4A—4A of FIG. 4.

Because the cylinder base covering 62 has a smooth, low friction surface, its attachment surface areas should be treated or modified to provide secure adhesive bonding with the reinforcement strips 70G and 70T. According to one method, the smooth, low friction attachment surfaces on the gripper and tail portions are roughened by etching the attachment surfaces with a mild solution of hydrochloric acid, or by abrading the attachment surface area with an emery cloth or a rotary flail. Preferably, the attachment surface areas are modified by covering them with bonding strips 91, 95 preferably constructed of thin strips of polyester film, for example as sold by DuPont under its brand name MYLAR™. The bonding strips are permanently attached onto the gripper and tail attachment surface areas as shown in FIG. 4 and FIG. 4A. Attachment of the polyester film strips 91, 95 is preferably made by threaded stitchings 93, 97 that penetrate the polyester strips and the cylinder base covering 62. The adhesive sides 70A of the reinforcement strips 70G, 70T form a secure adhesive bond onto the polyester film bonding strips 91, 95. The reinforcement strips are further secured by the projecting tab portions 70E that are wrapped around and adhesively attached to the underside or side edges of the transfer cylinder rim 34.

The problem caused by the stretchability of the original fabric covering has been solved, according to the present invention, by forming the flexible jacket covering 68 of a pre-stretched, pre-flattened, dimensionally stable fabric material. The pre-stretched, pre-flattened fabric material is pre-cut to a precise length and width dimensions to fit a particular transfer cylinder size so that on-press trimming, tightening and adjustment are eliminated.

Figure 7:
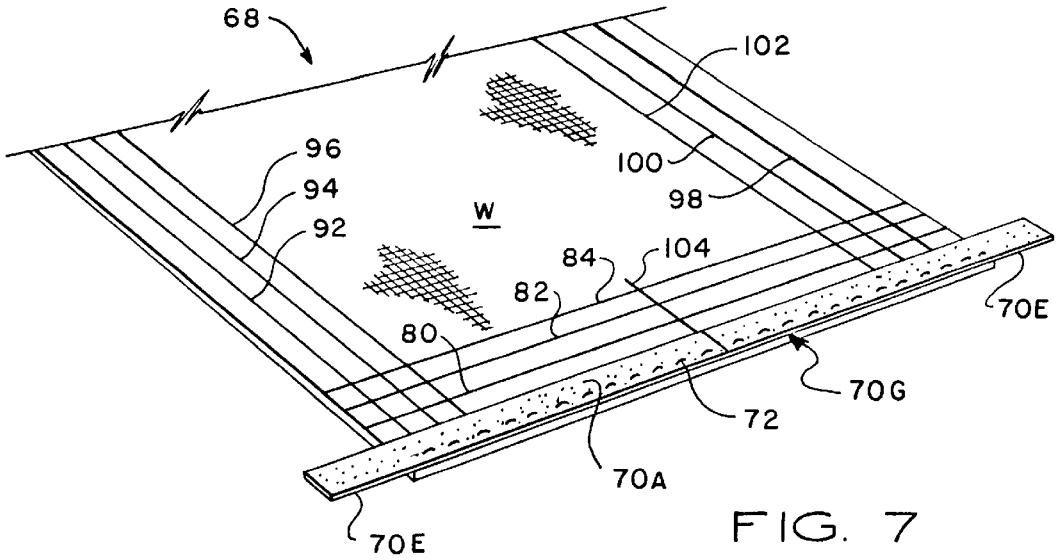
FIG. 7 is a top perspective view of a compact, prefabricated flexible jacket covering having a reinforcement strip permanently attached by threaded stitching onto the gripper edge of the compact, flexible jacket covering.

Referring to FIG. 6 and FIG. 7, the flexible jacket covering 68 is pre-cut to a compact size so that it does not cover the entire width of the cylinder base covering 62, and marginal side surfaces M of the cylinder base covering 62 are exposed on opposite sides of the flexible jacket covering 68. The compact, reduced-size flexible jacket covering embodiment 68 shown in FIG. 7 is intended for use in printing presses in which the clearance between the impression cylinder 26 and the delivery cylinder 10D or transfer cylinder 10 is less than about 40 mils (about 1 mm). Because of the pre-stretched, pre-flattened condition of the pre-fabricated flexible jacket covering, the marginal sides of the flexible jacket covering cannot deflect enough to contact or slap the impression cylinder. Consequently, the operator side and gear side reinforcement strips are not needed in the compact, reduced size embodiment.

For other presses where the clearance between the impression cylinder and the delivery cylinder or transfer cylinder is substantially larger, for example up to one inch (2.54 cm) or more, the pre-stretched, pre-flattened flexible jacket covering 68 is cut to the exact base cylinder covering size as shown in FIG. 5. The full-size flexible jacket covering 68 as shown in FIG. 5 extends around and on/or under the operator side edge and the gear side edge of the cylinder 34. Preferably, the side portions 68P, 68S of the flexible jacket covering 68 are adhesively secured to the underside of the transfer cylinder 34 by the exposed adhesive sides 70A of the reinforcement tape strips 70P and 70S.

In the transfer cylinder 10 as shown in FIG. 6 and FIG. 8, the prefabricated flexible jacket covering 68 is attached onto the low friction, conductive cylinder base covering 62 in the same manner, and the polyester film strips 91, 95 are stitched onto the low friction, conductive cylinder base covering 62 as described above. The transfer cylinder 10 includes a gripper bar 13, gripper pads 15 and gripper fingers 17 mounted adjacent the gripper edge 34G of the transfer cylinder rim 34. The low friction, conductive cylinder base covering 62 is securely attached onto the transfer cylinder 10 by the clamp plates 64, 66. The flexible jacket covering 68 is centered, aligned and attached onto the conductive cylinder base covering 62 by the adhesive reinforcement strips 70G, 70T as previously described in connection with the delivery transfer cylinder embodiment 10D. If necessary, the low friction bonding surfaces of the cylinder base covering 62 are modified as previously discussed to ensure reliable adhesive bonding of the reinforcement strips.

Technical Advantages of the Invention

The present invention provides a substantially improved yet simpler, faster and precise attachment of an inexpensive and reliable flexible jacket covering that cushions the freshly printed surface of a substrate as it is transferred by a transfer cylinder, without smearing or marking the printed surface and without damaging the printed material. The pre-fabricated, flexible jacket covering is quickly and easily replaced on any printing press with the aid of the reinforcement strips, alignment stripes and centering marks. Moreover, the flexible jacket covering is pre-stretched, pre-flattened and pre-cut to predetermined length and width dimensions so that a precise amount of looseness or movability of the flexible jacket covering is established when the flexible jacket covering is attached onto the transfer cylinder in the operative position. Once securely and accurately attached with the reinforcement strips, centering marks and alignment stripes, the pre-fabricated flexible jacket covering of the present invention does not require any subsequent tightening, adjustment or trimming. Moreover, the flexible jacket covering is securely attached onto the transfer cylinder by the reinforcement strips, with separation of the flexible jacket covering from the reinforcement strips and transfer cylinder being prevented by the permanently attached fasteners.

Because of the selected materials used in the preferred embodiments, the flexible jacket covering is environmentally safe and has increased service life. It is not necessary to wash the low friction, conductive cylinder base covering since the ink does not penetrate the ink repellent, conductive flexible jacket covering. The flexible jacket covering functions as an apron and thus prevents the transfer of ink onto the underlying low friction, conductive cylinder base covering, further eliminating maintenance time and labor, while improving printing quality and increasing productivity. Consequently, there are no contaminated clean-up rags to be handled and cleaned, and there are no toxic waste disposal problems. Because transfer cylinder clean-up is eliminated by the flexible jacket covering of the present invention, the exposure of press room personnel to transfer cylinder hazardous clean-up solvents is eliminated. Moreover, the risk of transfer cylinder clean-up injury to press room personnel is also eliminated since it is not necessary to reach into the cylinder nip region to wash the ink off the transfer cylinder support surface.

What is claimed is:

1. In a printing press including a transfer cylinder having a predetermined size, a cylindrical support surface for transferring a freshly printed substrate, and a flexible fabric jacket covering attached onto the transfer cylinder in an operative position overlying the cylindrical support surface for cushioning a freshly printed substrate as it is transferred through the printing press, the flexible fabric jacket covering sized along jacket edge portions having predetermined length and width dimensions to fit the predetermined transfer cylinder size without trimming, and including a reinforcement strip attached to the flexible fabric jacket covering in alignment with at least one of the flexible jacket edge portions, fastener means securing the reinforcement strip onto the flexible jacket covering, and said reinforcement strip having pressure sensitive adhesive disposed in adhesive bonding contact with the transfer cylinder.

2. The invention as defined in claim 1, wherein the flexible jacket covering has a gripper edge and a tail edge, and the reinforcement strip is attached to either the gripper edge or the tail edge, including at least one alignment stripe, the said at least one alignment stripe extending in perpendicular relation to the reinforcement strip.

3. The invention as defined in claim 1, wherein the transfer cylinder has a gripper edge portion and a tail edge portion, and said reinforcement strip is attached by adhesion contact onto the gripper edge portion, the flexible fabric jacket cut to a size having a predetermined amount of circumferential movement or radial displacement of the flexible jacket covering relative to the transfer cylinder support surface when operated in a printing press.

4. The invention as defined in claim 3, wherein the flexible jacket covering attached to the transfer cylinder in the operative position is movable or displaceable about one-sixteenth inch, about 2 mm, to about two inches, about 50 mm, relative to the transfer cylinder support surface in response to smoothing hand pressure applied to the flexible jacket covering.

5. The invention as defined in claim 1, wherein the flexible jacket covering comprises cotton cheesecloth.

6. The invention as defined in claim 2, wherein the flexible jacket covering includes two or more alignment stripes in parallel alignment with the gripper edge, and two or more alignment stripes formed in parallel alignment with each other and in perpendicular relation to the gripper edge and to the tail edge, thereby forming a rectangular grid alignment pattern.

7. The invention as defined in claim 6, wherein alignment stripes are formed of at least two different colors, respectively.

8. The invention as defined in claim 1, wherein the flexible jacket covering comprises an ink repellent compound.

9. The invention as defined in claim 2, wherein the flexible jacket covering comprises an electrically conductive compound.

10. The invention as defined in claim 1, wherein the transfer cylinder has a gripper edge portion, a tail edge portion, an operator side edge and a gear side edge, and the flexible jacket covering has an operator side edge and a gear side edge, further including:

first and second fasteners attaching the operator side edge and gear side edge of the flexible jacket covering onto the operator side edge and gear side edge of the transfer cylinder, respectively.

11. The invention as defined in claim 10, wherein:

the first and second fasteners are disposed circumferentially intermediates a longitudinal center line and the tail edge of the flexible jacket covering when the flexible jacket covering is attached in the operative position.

12. A method for attaching a flexible fabric jacket covering onto a transfer cylinder having a width, a transfer surface, a gripper end portion and a tail end portion, said flexible jacket covering having a gripper edge for attachment onto the gripper end portion and having a tail edge for attachment onto the tail end portion of the transfer cylinder, comprising the steps:

providing the flexible fabric jacket covering prefabricated to a width and having a length selected to extend around a support surface of the transfer cylinder from the gripper edge to the tail edge;

attaching a reinforcement strip to the gripper edge of the flexible jacket covering, said reinforcement strip having pressure sensitive adhesive disposed for adhesive bonding contact with the transfer cylinder, and fastener means securing the reinforcement strip onto the flexible jacket covering;

positioning the flexible fabric jacket covering onto the transfer cylinder;

attaching the adhesive side of the reinforcement strip onto the gripper end portion of the transfer cylinder; and, attaching the tail edge of the flexible jacket covering onto the tail edge portion of the transfer cylinder.

13. A method for attaching a flexible jacket covering as defined in claim 12, including the steps:

forming at least one centering mark on the flexible fabric jacket covering;

forming at least one centering mark on the transfer cylinder; and positioning the flexible fabric jacket transfer covering onto the transfer cylinder with the centering marks in registration with each other.

14. A method for attaching a flexible jacket covering as defined in claim 12, including the steps:

attaching a cylinder base covering onto the transfer cylinder, the cylindrical base covering having a gripper end portion and tail edge portion;

positioning the flexible jacket covering onto the cylinder base covering;

attaching the adhesive side of the reinforcement strip onto the gripper end portion of the cylinder base covering; and, attaching the tail edge of the flexible jacket covering onto the tail edge portion of the cylinder base covering.

15. A method for attaching a flexible jacket covering as defined in claim 12, including the step of pre-cutting the flexible jacket covering to predetermined size dimensions that permit movement of the flexible jacket covering relative to the transfer cylinder surface from about one-sixteenth inch to about four inches in response to smoothing hand pressure applied to the flexible jacket covering.

16. A method for attaching a flexible jacket covering as defined in claim 12, wherein a cylinder base covering is attached onto the transfer cylinder, including the steps:

forming at least one centering mark at a gripper end or tail end of the cylinder base covering; and, positioning the at least one centering mark on the flexible jacket covering in registration with the at least one centering mark on the cylinder base covering.

17. A method attaching a flexible jacket covering as set forth in claim 12, including the steps:

forming the flexible jacket covering with at least one alignment stripe;

attaching the reinforcement strip onto the flexible jacket covering substantially in parallel alignment with the at least one alignment stripe.

18. A method for attaching a flexible jacket covering to a transfer cylinder as set forth in claim 12 wherein the transfer cylinder has a predetermined size, including the steps:

pre-cutting the flexible jacket covering along jacket edge portions having predetermined length and width dimensions for loosely fitting attachment of the flexible jacket covering onto the transfer cylinder of predetermined size, so that on-press trimming, tightening and adjusting are eliminated;

attaching additional reinforcement strips along at least two of the pre-cut jacket edge portions; and, securing the additional reinforcement strips onto the transfer cylinder.

19. A method for attaching a flexible jacket covering as set forth in claim 12, including the steps:

forming at least one alignment stripe on the flexible jacket covering in alignment with the flexible jacket gripper edge; and, attaching the reinforcement strip onto the gripper end portion of the transfer cylinder so that the at least one alignment stripe is positioned in alignment with the transfer cylinder gripper end.

20. A method for attaching a flexible jacket covering onto a transfer cylinder as set forth in claim 12, including the steps:

treating the flexible jacket covering with an ink-repellent compound;

treating the flexible jacket covering with an electrically conductive, anti-static compound; and, pre-stretching the treated flexible jacket covering until it is dimensionally stable.

21. A flexible fabric jacket covering adapted to be attached to a printing press transfer cylinder of the type having a width determined by opposite side edges and a curved support surface extending between a gripper edge and a tail edge, to prevent marking freshly printed sheets, the flexible fabric jacket comprising:

flexible fabric material prefabricated to a width and length selected to extend around the support surface of a transfer cylinder from the gripper edge to the tail edge;

the length of flexible fabric material terminating in a gripper edge and a tail edge;

a reinforcement strip attached along the gripper edge of the flexible fabric material, at least one side of said reinforcement strip having pressure sensitive adhesive disposed for adhesive contact with the transfer cylinder support surface; and fastener means securing the reinforcement strip onto the flexible fabric material.

22. The flexible fabric jacket covering as defined in claim 21 wherein the side edges of the transfer cylinder are denominated by an operator side edge and a gear side edge and the reinforcement strip has at least one end portion selected to extend beyond the operator side or gear side edge, thereby determining at least one adhesive tape fastener for folding around an edge of the transfer cylinder for the purpose of holding the flexible fabric jacket in place.

23. The flexible fabric jacket as defined in claim 21, including at least one alignment stripe in alignment with the gripper edge of the fabric material.

24. The flexible fabric jacket covering of claim 23 wherein said at least one alignment stripe comprises a plurality of spaced apart conductive alignment stripes.

25. The flexible fabric jacket covering as defined in claim 21 wherein the fabric comprises woven strands or threads, wherein at least one strand or thread extending in a predetermined direction has a color that contrasts with the color of other strands or threads, thereby defining at least one alignment stripe in the fabric material.

26. The flexible fabric jacket covering as defined in claim 25 wherein said at least one alignment stripe comprises a plurality of spaced apart conductive alignment stripes.

27. The flexible fabric jacket covering as defined in claim 21 wherein the fabric material from which the jacket is made is pre-stretched and pre-flattened so that it is dimensionally stable when used as a covering on a transfer cylinder in a printing press.

28. The flexible fabric jacket covering as defined in claim 21, wherein the flexible jacket covering comprises a fabric material substantially resisting elongation in response to tension forces, characterized in that the elongation of the flexible fabric jacket covering is less than about two percent (2%) of its relaxed length when used as a covering on a transfer cylinder in a printing press.

29. The flexible fabric jacket covering as defined in claim 21, wherein the fabric comprises a woven material having a strength and the elongation rating that does not exceed about seven percent (7%) in warp elongation at breakage, and does not exceed about twelve percent (12%) in weft elongation at breakage.

30. A flexible fabric jacket covering as defined in claim 21, wherein the flexible jacket covering comprises woven strands or threads of a natural material selected from the group consisting of cotton, hemp, wool, silk, and linen.

31. The flexible fabric jacket covering as defined in claim 21, wherein the fabric comprises woven strands or threads of a polymer or copolymer selected from the group consisting of polyester, polyacrylate, polyolefin, polyimide and polyamide.

32. The flexible fabric jacket covering as defined in claim 21, wherein the fabric comprises a sheet of open cell or closed cell polyester foam.

33. A flexible fabric jacket covering as defined in claim 21, wherein the fastener means comprises a threaded stitching that penetrates the reinforcement strip and the flexible jacket covering.

34. The flexible fabric jacket covering as defined in claim 21, wherein the fastener means is a mechanical fastener that penetrates the reinforcement strip and the flexible jacket covering material.

35. The flexible fabric jacket covering as defined in claim 34, wherein the mechanical fastener comprises a staple.

36. The flexible fabric jacket covering as defined in claim 21, wherein the reinforcement strip comprises double-sided tape having pressure sensitive adhesive disposed on opposite sides of the tape.

37. The flexible fabric jacket covering as defined in claim 21, wherein the fastening means is a deposit of thermoset adhesive disposed between the flexible jacket covering and the reinforcement strip, wherein the reinforcement strip and the flexible jacket covering are secured together by an adhesive bond formed by the deposit of thermoset adhesive.

38. The flexible fabric jacket covering as defined in claim 21, wherein the fastening means is a deposit of contact cement disposed between the reinforcement strip and the flexible jacket covering, wherein the reinforcement strip and the jacket material are secured together by an adhesive bond formed by the deposit of contact adhesive.

39. The flexible fabric jacket covering as defined in claim 21, wherein the fastening means comprises a body of thermoplastic material coupled between the flexible jacket covering material and the reinforcement strip, wherein the reinforcement strip and the flexible jacket covering are secured together by an embedded union of the thermoplastic material with the flexible jacket covering and a thermoplastic welded union with the reinforcement strip.

40. The flexible fabric jacket covering as defined in claim 21, wherein the fastening means comprises a mechanical clamp having first and second clamping jaws, wherein the flexible jacket covering and the reinforcement strip are compressed together between the first and second clamping jaws.

41. A flexible fabric jacket and base covering adapted to be attached to a printing press transfer cylinder of the type having a width determined by opposite side edges and a curved support surface extending between a gripper edge and a tail edge, to prevent marking freshly printed sheets, the flexible fabric jacket and base covering comprising:

a low friction, conductive base covering layer cut and finished to a predetermined size selected to extend between the gripper edge and tail edge and adapted for mounting on the support surface;

flexible fabric material prefabricated to said predetermined size selected to extend between the gripper edge and the tail edge and lay over the base covering layer;

the length of prefabricated fabric material terminating in a gripper edge and a tail edge;

a reinforcement strip attached along a gripper edge of the flexible fabric material, at least one side of said reinforcement strip having pressure sensitive adhesive disposed for adhesive contact with the base covering; and fastener means securing the reinforcement strip onto the flexible fabric material.

42. The flexible fabric jacket and base covering as defined in claim 41 wherein the base covering layer has a gripper end and tail end and a bonding strip attached thereto along one of said ends and adapted to receive the reinforcement strip in adhesive attachment to secure the flexible fabric jacket to the base covering layer.

43. The flexible fabric jacket and base covering as defined in claim 42 further including a bonding strip attached to both the gripper end and tail end of the base covering layer and a second reinforcement strip attached along a tail end of the flexible fabric material whereby both gripper end and tail end of the flexible fabric material can be adhesively mounted on the base covering with the fabric flexible fabric material disposed over the base covering.

* * * * *